United States Patent [19]

Doudet

[11] 4,020,668

[45] May 3, 1977

[54] DRAW PRESS

[75] Inventor: Michel Doudet, Jouy-en-Josas, France

[73] Assignee: Secim, Courbevoie, France

[22] Filed: Sept. 25, 1975

[21] Appl. No.: 616,893

[30] Foreign Application Priority Data

Oct. 22, 1974 France ..... 74.35362

[52] U.S. Cl. ..... 72/285; 29/568; 72/447; 72/455

[51] Int. Cl.[2] ..... B21C 25/02

[58] Field of Search ..... 72/446, 447, 448, 455, 72/285, 274; 29/568; 83/700, 698; 100/DIG. 18

[56] References Cited

UNITED STATES PATENTS

| | | | |
|---|---|---|---|
| 2,988,234 | 6/1961 | Barothy | 214/1 |
| 3,422,662 | 1/1969 | Geuss | 72/448 |
| 3,452,632 | 7/1969 | Brolund | 83/698 |
| 3,584,374 | 6/1971 | Spuhler | 29/568 |
| 3,638,523 | 2/1972 | Yasuda | 83/700 |

*Primary Examiner*—C.W. Lanham
*Assistant Examiner*—Gene P. Crosby

[57] ABSTRACT

A draw press comprises a die-stock coupled to a slide movable perpendicularly to the axis of the press between two operational positions. In a first position the die-stock is placed on the axis of the press, and in a second position the die-stock is spaced laterally from the axis in a changing device. The latter includes a table contiguous with a bed of the press and movable carriage for supporting a replacement die-stock, spaced laterally from the axis of the press, and movable on the table in a direction parallel to the axis between a rest position and a position for coupling the replacement die-stock to the slide. The disengagement of the die-stock in position on the slide is caused by movement of the carriage from the rest position to the coupling position. The die-stock changing device includes means for sliding the disengaged die-stock along the carriage and means for fixing the die-stocks relative to the carriage.

4 Claims, 6 Drawing Figures

DRAW PRESS

The present invention relates to improvements in draw presses.

Draw presses are known which comprise a die-stock, equipped with a detachable coupling means, on a slide which is movable perpendicular to the axis of the press between a first operational position in which the die-stock is placed on the axis of the press and a second position for changing the die-stock which is spaced laterally from the axis of the press and is adjacent a die-stock changing device. Such a device comprises a table contiguous with the bed of the press and a carriage for supporting a replacement die-stock, spaced laterally from the axis of the press and movable on the table, parallel to the drawing axis, between a position of rest and a position of coupling to the replacement die-stock slide. The die-stock changing device and the movable slide cooperate in such a manner that the coupling to the slide of a replacement die-stock waiting on the carriage and the disengagement of the die-stock already in position on the slide are caused by the passage of the movable carriage from the position of rest to the coupling position.

Such a device has the advantage of being able to effect a rapid change of die-stocks, as a result of simple mechanisms and movements, and hence of limiting the stoppage time of the press. The stopping of the press is actually only necessary when die-stocks are changed, the changing or the removal of new or worn dies in or from the die-stocks being effected during the time that the press is in operation.

On the other hand, such a device has the disadvantage of necessitating two die changing stations, the die-stocks disengaged from the movable slide being situated alternately at one side or the other of the movable slide.

Another disadvantage of such a device is that it hampers access to the die in operation on the axis of the press, one of the positions of the waiting die-stocks being situated beyond the movable slide, at the side where the billet container is; this limitation of access to the dies in operation may be an obstacle to satisfactory running of the press and a source of difficulty.

According to the invention there is provided a draw press comprising a die-stock equipped with coupling means and coupled to a slide movable perpendicularly to the axis of the press between a first position of operation, in which the die-stock is placed on the axis of the press, and a second position for changing the die-stock, in which the die-stock is spaced laterally from the axis of the press in a die-stock changing device comprising a table contiguous with the bed of the press and a carriage for supporting a replacement die-stock, spaced laterally from the axis of the press, and movable on the table in a direction parallel to the axis of the press between a position of rest and a position for coupling the replacement die-stock to the slide, the disengagement of the die-stock in position on the slide being caused by movement of the movable carriage from the position of rest to the coupling position, whereby the die-stock changing device includes means for sliding the disengaged die-stock along the carriage and means for fixing the die-stocks relative to the carriage.

The means for sliding the disengaged die-stock on the movable carriage is preferably mounted directly on the movable carriage, so as not to cause additional bulk.

The invention will be more fully understood from the following description of an embodiment thereof, givenby way of example only, with reference to the accompanying drawings.

Figure 1:
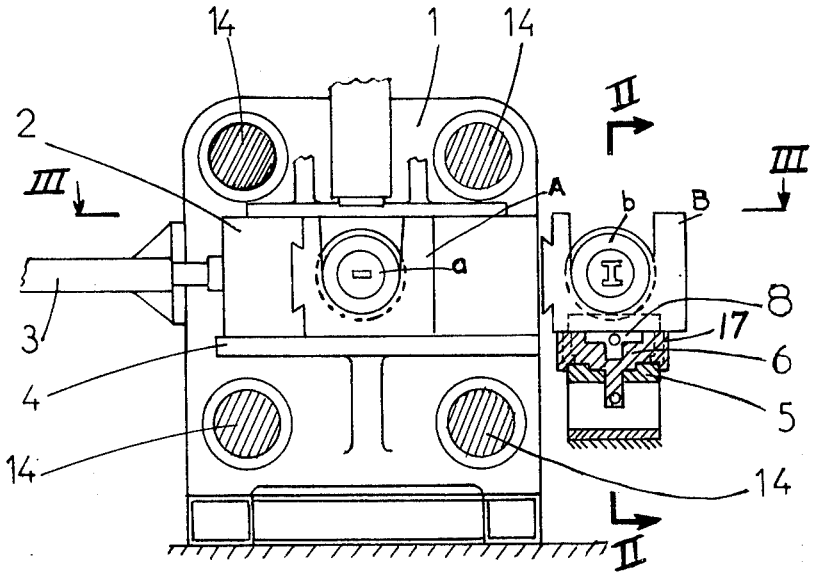
FIG. 1 is a front view of the bed of an exemplary embodiment of a draw press provided with a die-stock changing device according to the invention, taken on the line I—I of FIG. 2.

Only the parts of the press necessary for an understanding of the invention have been illustrated in the drawings, the rest of the press being of any suitable known design.

The draw press comprises a bed 1 connnected by columns 14 to a cross-bar on which a main hydraulic cylinder (not shown) is supported. A slide 2 is displacable transversely of the axis of the press, on a table provided with a guide 4 and rigidly connected to the bed 1, by means of a double-acting jack 3 fixed to the bed of the press. The movable slide 2 is connected in a detachable manner, e.g. by means of a known dove-tail fitting to a die-stock A in which there is mounted a set of tools *a* corresponding to a type of section produced by the press.

At the side of the bed of the press opposite the jack 3 there is a die-stock changing device consisting of a carriage 6 which is movable by means of a double-acting jack 7 (FIG. 2) on a guide table 5 contiguous with the bed of the press. A die-stock B, in which a set of tools *b* is mounted, is in the waiting position on the movable carriage 6. A double-acting jack 9 is fixed to the movable carriage 6, at the end adjacent the waiting position and constitutes sliding means for the disengaged die-stock.

Figure 2:
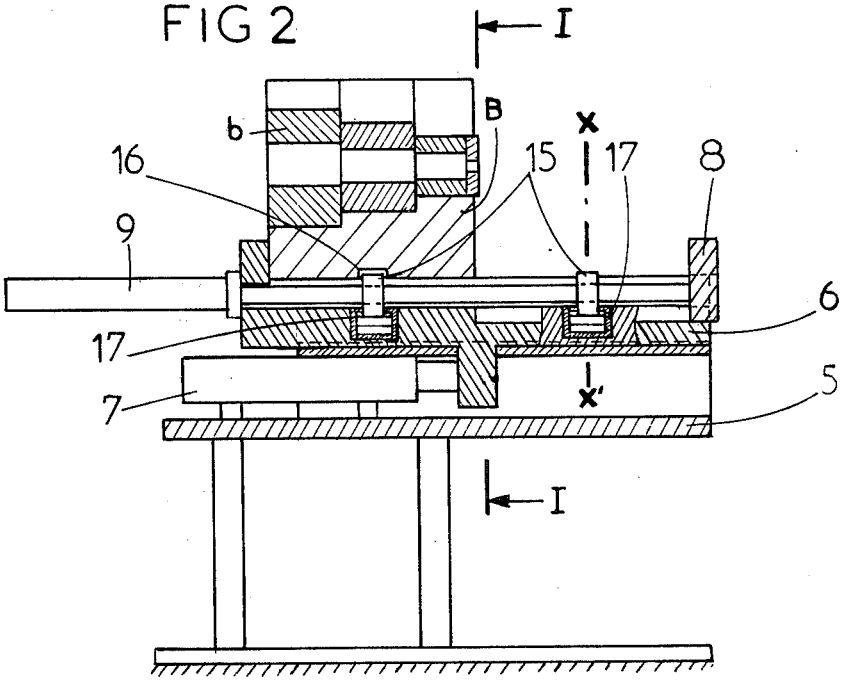
FIG. 2 is a section, on a larger scale, on the line II—II of FIG. 1.

The rod of the piston of this jack is equipped at its end with a stop 8, the travel of the piston being at least equal to the longitudinal dimension of a die-stock, in such a manner that the die-stock A, centred in the plane X—X′ of FIG. 2, can be placed on the movable carriage by displacement of the movable slide, between the die-stock B and the stop 8.

Figure 4:
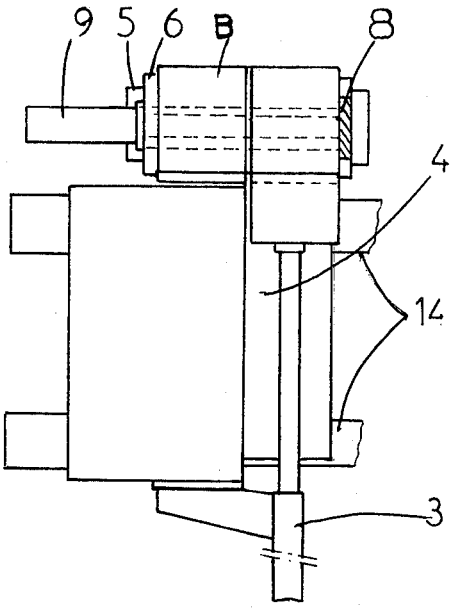
Figure 5:
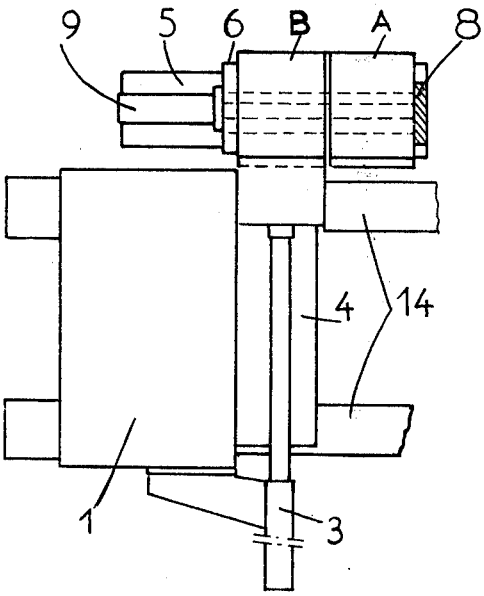

The travel of the piston of the jack 3 is such that the die-stock A can be displaced from a first position, in which the set of tools *a* is in operative position on the axis of the press, to a second position in which the die-stock is placed on the movable carriage 6, which is adapted to receive two die-stocks one behind the other, as illustrated in FIGS. 4 and 5.

Figure 3:
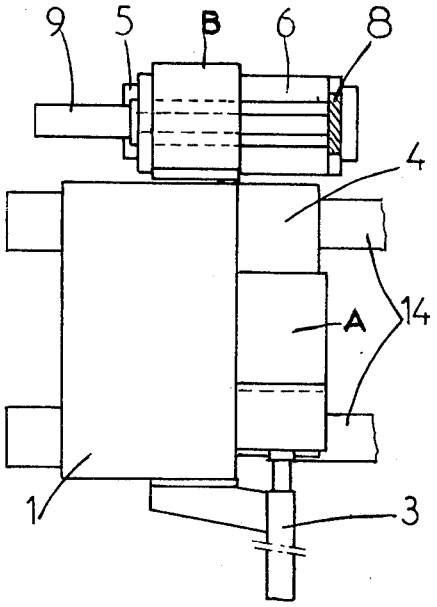
FIGS. 3 to 6 illustrate various stages of a die-stock changing operation carried out on the draw press of FIG. 1, the views being taken on the line III—III of FIG. 1.

When, in accordance with the production requirements of the press, the set of tools *a* mounted in the die-stock A has to be replaced by the set of tools *b* previously mounted in the die-stock B placed in the waiting position (FIG. 3) on the movable carriage 6, the slide 2 is displaced transversely relative to the axis of the press by the jack 3 so as to bring the die-stock A into position on the movable carriage 6 (FIG. 4).

Figure 6:
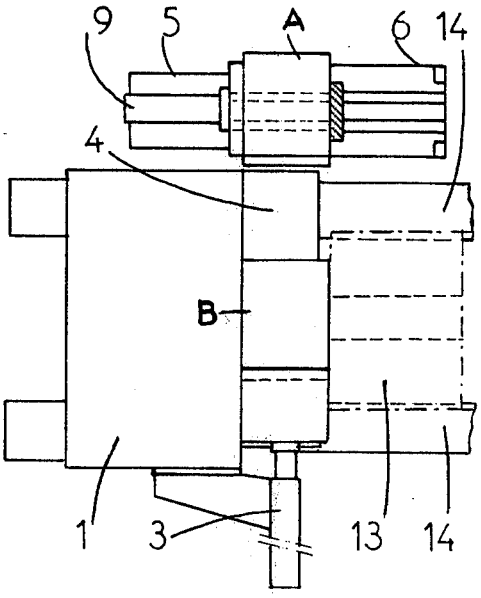

The jack 7 then displaces the movable carriage 6 in a direction parallel to the axis of the press, along the table 5, so that the die-stock A is thereby disengaged from the movable slide and the die-stock B is engaged in the slide 2 (FIG. 5). The die-stock B is then brought into the operative position with the set of tools *b* on the axis of the press, by displacement of the slide 2 by means of the jack 3. Once the set of tools *b* is in position on the axis of the press, a billet container 13, illustrated in broken lines, can be brought against this set of tools and the production of the press can continue (FIG. 6).

During this time, the die-stock A is displaced along the movable carriage to the position previously occupied by the die-stock B (FIG. 6) by means of the stop 8 driven by the rod of the piston of the jack 9. When this operation is terminated, the movable carriage is restored to its initial position (FIG. 3) by means of the jack 7, the die-stock A then being in the position which the die-stock B originally occupied, set back from the bed of the press, in such a manner that personnel have free access to the set of tools *b* in operation on the press.

The stop 8 then returns to its initial position at the end of the movable carriage opposite the waiting position. In this waiting position, the worn set of tools *a* can be withdrawn from the die-stock A and be replaced by another set of tools without hampering the operation of the press.

During the operation of disengagement and coupling of the die-stocks A and B, it is necessary for the position of these to be exactly positioned on the movable carriage, so that the subsequent transverse movement of the movable slide can take place and not be blocked, for example by incomplete disengagement of the die-stock A. For this purpose, means are provided for fixing the die-stocks on the movable carriage, during this operation. This connection means comprises two jacks cylinders 17 of which are mounted in the movable carriage and piston rods 15 of which are adapted to penetrate into a seating 16 formed in one face of each die-stock during the operation of disengagement and coupling of the die-stocks, the jacks being otherwise retracted so as to permit mobility of the die-stocks on the movable carriage.

Of course, the invention is not intended to be restricted to the embodiment illustrated but includes variants particularly provided by the use of equivalent means.

What is claimed is:

1. A draw press comprising a bed; a press die-stock; a slide movable perpendicularly to the axis of the press between first and second positions; means for coupling said press die-stock to said slide, said press die-stock being positioned in an operative position on the press axis in the first position of said slide and spaced laterally from the press axis in the second position thereof; a die-stock changing device at the second position of said slide, said device including: a table contiguous with said bed; a carriage for supporting a replacement die-stock, spaced laterally from the press axis, and movable on said table in a direction parallel to the press axis between an inoperative position and an operative position for coupling said replacement die-stock to said slide, the disengagement of said press die-stock coupled to said slide being caused by movement of said carriage from the inoperative to the operative position; wherein said die-stock changing device includes means for sliding the disengaged press die-stock along said movable carriage, and means for fixing said die-stocks relative to said carriage.

2. The draw press as defined in claim 1, wherein said fixing means includes piston rods of jacks, cylinders of which being mounted in said movable carriage, and seatings being formed in said die-stocks, that correspond to each piston rod.

3. The draw press as defined in claim 1, wherein said sliding means is mounted directly on said movable carriage and is operable to move said press die-stock from one end to the other end thereof.

4. The draw press as defined in claim 3, wherein said sliding means includes a jack, one element of which is fixed relative to said movable carriage, and another element of which is rigidly connected to a stop.

* * * * *